United States Patent [19]

Dunsworth

[11] Patent Number: 4,649,129

[45] Date of Patent: Mar. 10, 1987

[54] HYGROSCOPIC COMPOSITION FOR FIRE RESISTANT EXPANSION JOINT COVER

[75] Inventor: Charles L. Dunsworth, Midwest City, Okla.

[73] Assignee: Metalines, Inc., Oklahoma City, Okla.

[21] Appl. No.: 619,777

[22] Filed: Jul. 30, 1984

Related U.S. Application Data

[62] Division of Ser. No. 465,195, Feb. 9, 1983, Pat. No. 4,517,779.

[51] Int. Cl.[4] ..... B01J 20/10

[52] U.S. Cl. ..... 502/407; 502/237

[58] Field of Search ..... 502/232, 237, 250, 407

[56] References Cited

U.S. PATENT DOCUMENTS

| | | | |
|---|---|---|---|
| 2,202,742 | 5/1940 | McCorkhill | 502/407 X |
| 2,625,516 | 1/1953 | Metzger et al. | 502/407 X |
| 3,070,426 | 12/1962 | Winyall | 502/232 |
| 3,254,144 | 5/1966 | Mogensen et al. | 502/250 X |
| 3,873,332 | 3/1975 | McCreight | 106/110 X |

FOREIGN PATENT DOCUMENTS

| | | | |
|---|---|---|---|
| 58524 | 5/1978 | Japan | 502/250 |

*Primary Examiner*—Carl F. Dees

*Attorney, Agent, or Firm*—Laney, Dougherty, Hessin & Beavers

[57] ABSTRACT

Fire-resistant expansion joint apparatus of a type having opposed base connectors secured to movable structures defining an expansion void therebetween, and a fire barrier assembly slidingly maintained between said base connectors with a saturated adsorbent contained within the barrier assembly that releases coolant liquid by a wicking process into cooling chambers formed within said base connectors during application of high heat condition.

6 Claims, 4 Drawing Figures

HYGROSCOPIC COMPOSITION FOR FIRE RESISTANT EXPANSION JOINT COVER

This is a division of Application Ser. No. 465,195, filed Feb. 9, 1983 U.S. Pat. No. 4,517,779.

BACKGROUND OF THE INVENTION

The invention relates generally to expansion joint covers and, more particularly, but not by way of limitation, it relates to improved expansion joint covers having exceptional fire resistance qualities for utilization in building structures.

Description of the Prior Art

The prior art includes a large number of different types of expansion joint cover as utilized variously between pavement sections, adjoining building structures, floor and wall joints, and the like. Expansion joint covers having fire resistant barriers incorporated therein are well-known in the prior art and have generally taken the form of a structure having exposed surfaces formed of nonflammable, metallic material as used in combination with a heat barrier that is slidably maintained across the expansion joint. Such heat barriers may take the form of a steel enclosure defining a void that is filled with a nonflammable granular material such as mixtures of perlite or vermiculite with cement and plaster compositions. Such prior fire barrier units of solely insulative material are designed only to retard the spread of flame and their actual fire endurance during specific occurrences may be quite limited.

SUMMARY OF THE INVENTION

The present invention relates to an improved type of fire resistant expansion joint cover which may be utilized variously in floor-to-floor applications as well as floor-to-wall, gypsum wall and all other forms of structural expansion joint wherein it may be desirable to fireproof. The fire resistant expansion joint covers consist of a surface or base structure for secure affixure on each side of the expansion joint to provide a tight, sealing engagement with a barrier structure, in some cases a sliding engagement as in the case of expansion floor joints. The barrier structure itself is formed of nonflammable metallic structure to provide a void which is then filled with a saturated fire barrier composition which, due to hygroscopic adsorption, will maintain its liquid content for long duration until presence of intense heat sufficient to vaporize and release liquid vapors therefrom. In addition, it is usual to include some form of centering structure affixed to the barrier for the purpose of maintaining the barrier in equal load disposition over the expansion joint clearance, i.e. the space between opposed edges of the expanding and contracting structures. Still further, some applications benefit from inclusion of a flexible smoke barrier member as secured between the upper reaches of the barrier and the adjacent structure thereby to stifle the spread of smoke upward through the expansion joint void during a fire condition.

Therefore, it is an object of the present invention to provide an expansion joint cover that is more effective in preventing spread of flame and prevasion of smoke.

It is also an object of the present invention to provide an expansion joint cover with increased effectiveness as a fire and smoke barrier.

It is an object of the invention to provide a fire barrier composition with heat-induced release of vapor as may be employed across an expansion joint.

It is yet further an object of the present invention to provide a flexible smoke barrier material capable of withstanding extremely high temperatures while sealing an expansion void.

Finally, it is an object of the present invention to provide expansion joint cover materials and technique that exhibit much increased fire resistance and smoke control functions.

Other objects and advantages of the invention will be evident from the following detailed description when read in conjunction with the accompanying drawings which illustrate the invention.

DETAILED DESCRIPTION OF THE INVENTION

Figure 1:
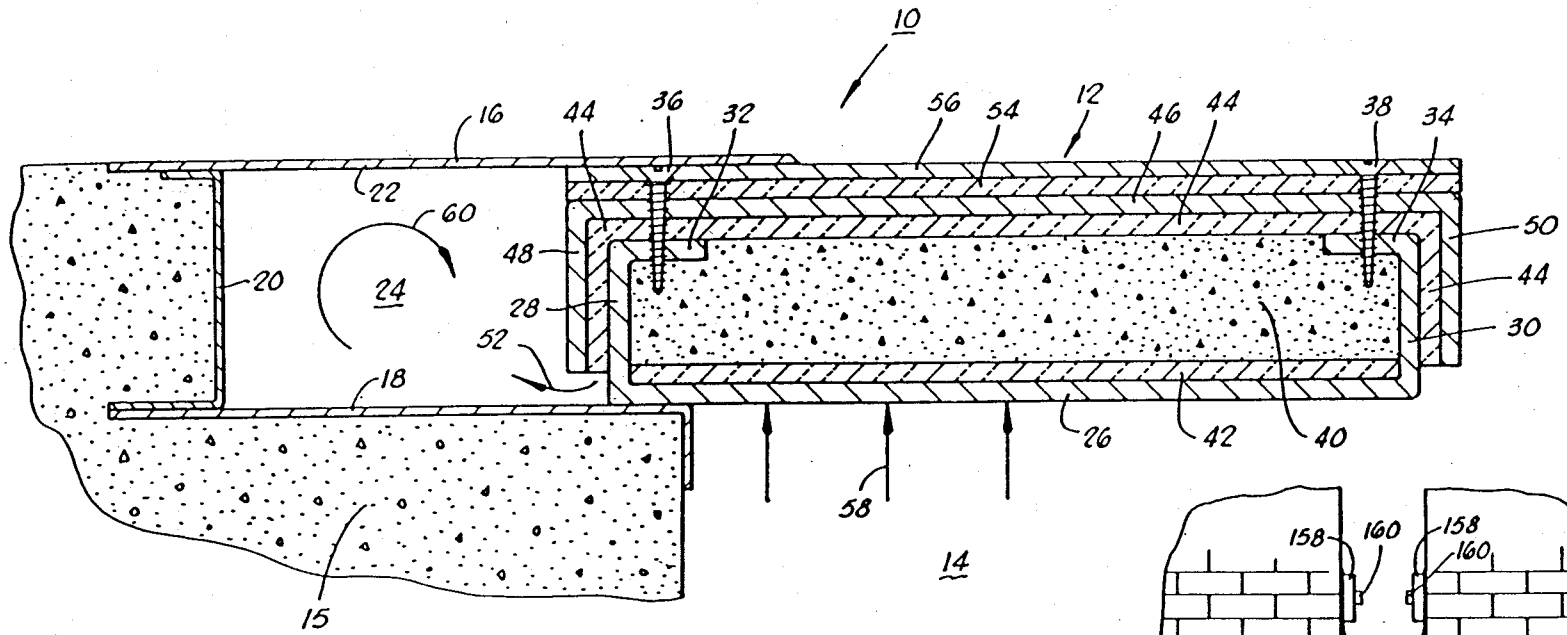
FIG. 1 is a view in vertical section of an expansion joint cover assembly constructed in accordance with the present invention.

FIG. 1 illustrates an expansion joint cover 10 having cover assembly 12 disposed over expansion void 14 and in operative connection to an adjacent structural member 15, shown in this case as a concrete shoulder formation, e.g. a floor or the like. A base member 16 including base plate 18, side plate 20 and surface plate 22 is suitably grouted or cast into the outer corner of structural member 15, and base member 16 defines a cooling void 24 for receiving the laterally sliding joint cover assembly 12. The expansion joint cover 10 is, of course, formed in selected lengths up to many feet to accommodate the various expansion joints as will be encountered in various construction applications.

Joint cover assembly 12 consists of a bottom panel 26 having opposite sides 28 and 30 as unitarily formed and including opposite side flanges 32 and 34 for threadedly receiving respective opposite side securing fasteners 36 and 38 as spaced along the length of cover assembly 12. The bottom panel 26 and unitarily formed side members form a cuboid volume that is filled with a barrier composition 40, a moisture producing fireproof composition, as will be further described below. A sheet of insulation 42, e.g. ceramic paper as obtained from the Carborundum Company of Niagara Falls, N.Y. or other form of insulative material of permeable structure, is placed in selected thickness on the bottom of lower panel 26 to receive the barrier composition 40 thereon.

A next layer of insulation 44, e.g. ceramic paper, is then placed in envelopment over the upper surface of barrier composition 40, flanges 32 and 34 and panel sides 28 and 30, and a panel cover 46 is secured tightly downward thereover. Thus, panel cover 46 includes opposite sides 48 and 50 which are received and secured in close affixure down over the layer of insulation 44 and lower panel sides 28 and 30. This structure then essentially provides a sealed moisture producing barrier composition 40 which is capable of releasing vapor when heated so that such vapor permeates through the porous insulation 44 for release, as at arrow 52, to circulate within the cooling chamber or void space 24 for condensation around the upper reaches thereof.

Additional barrier support is generally provided by inclusion of yet another layer of insulation 54, e.g. ceramic paper, as covered by another upper panel or metallic cover plate 56. The various layers and panels are then tightly secured by opposite side fasteners 36 and 38 so that barrier composition 40 is confined to retain saturated aggregate until such time as it is in the presence of sufficient heat to cause vaporization and permeation through the porous insulation 44 for release as along arrow 52. The cover panel 56 and the bottom of lower panel 26 are adapted to be tightly received within shoulder member 16 for sliding engagement beneath upper panel 22 and lower panel 18 thereof, this providing the requisite expansion and contraction accommodation. The metal panels of the cover 10 may be constructed from such as carbon steel, stainless steel, bronze, etc.

Basically, the expansion joint cover 12 seals off over the expansion void 14 but is also adapted to combat intense heat coming from below. The barrier composition 40 is originally formed and constructed to include a hygroscopic material that is saturated or in total adsorption of water prior to installation. The cover panel assembly 12 is then capable of maintaining the totally saturated barrier composition 40 for considerably long periods of time at normal temperatures. The barrier composition 40 is formed as a mixture of silica gel mixed with either gypsum plaster or Portland cement in a selected ratio. For example, six parts silica gel to one part of the other constituent has been found effective; however, the use of silica gel alone has been satisfactory in some applications. The silica gel is a commercial grade material of selected mesh size as obtained from e.g., Davidson Chemical Division of W. R. Grace Company. Thus, the silica gel may be mixed with the lesser amount of binder material and saturated within lower panel 26 whereupon it sets up as the cover panel assembly 12 is finally constructed to include the sealing insulation 44, cover panel 46, etc. Any binder material will break down with heat increase.

The expansion joint cover 10 realizes fire barrier effectiveness due to the fact that when intense heat proceeds upward through the void 14, as at arrows 58, the barrier composition 40 is brought through intense heat to vaporize the adsorbed fluid content and to greatly increase pressure within the void beneath the ceramic paper insulation layer 44. The selectively porous nature of insulation layer 44 permits the vapor under elevated pressure to migrate outward for directed release onto heated gases from void 14, as at arrow 52, encroaching into the slide void 24 to effect cooling circulation therein as at arrow 60. Thus, the base plate 18 will be maintained at a more elevated temperature than the surface plate 22 due to its contact with the expansion void 14, and any condensate on surface plate 22 will drop to base plate 18 and revaporize to maintain a circulation 60. As some vapor may escape upward through the tight, sliding surface between upper surface plate 22 and cover plate 56, such vapor will be relatively cool in the range of ambient steam temperatures and much reduced from the more intense heat coming from below the barrier in expansion void 14. In effect, the slide void 24 functions as a cooling chamber as it circulates vapor and collects condensate released from the moisture producing composition 40.

Figure 2:
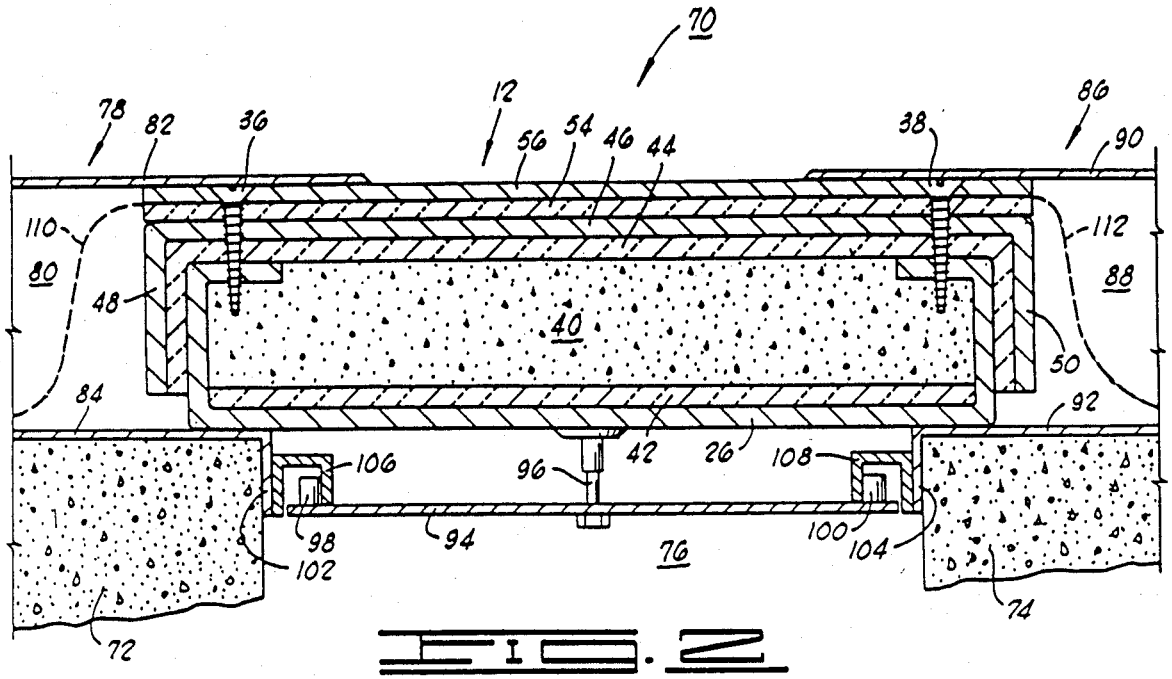
FIG. 2 is a view in vertical cross-section of an expansion joint cover that is employed in a floor-to-floor interconnection.

FIG. 2 illustrates a floor-to-floor expansion joint cover 70 as connected between two adjacent structural members 72 and 74 defining an expansion void 76 therebetween. The cover 70 includes a base assembly 78 suitably secured within structural member 72 to define a slide void 80 as between surface and base plates 82 and 84. In like manner, a base assembly 86 secured in structural member 74 defines a slide void 88 as between surface and base plates 90 and 92. The assembly then utilizes a joint cover 12 including barrier composition 40 for spanning the expansion joint void 76.

A plurality of diagonally arrayed spring steel centering bars 94 are utilized to maintain the cover assembly 12 equally supported by opposite structural members 72 and 74. Thus, centering bar 94 is centrally, rotatably connected to a pivot pin 96 that is suitably secured as by welding to the underside of bottom panel 26. Each of the centering bars 94 includes a cam pin 98 and 100 as secured on opposite ends of the centering bar 94 to extend upward therefrom. The opposite shoulder member base plates 84 and 92 each include a respective flange 102 and 104 which supports an inverted channel member 106 and 108, respectively, as may be secured by welding. Thus, as the widths of expansion void 76 change, cam pins 98 and 100 bearing within respective channels 106 and 108 rotate the centering bar 94 accordingly thereby to maintain equal distribution of cover assembly 12 as it rests on the respective shoulder member base plates 84 and 92. Design specifications and the expansion limits of void 76 dictate the length of centering bar 94.

Figure 3:
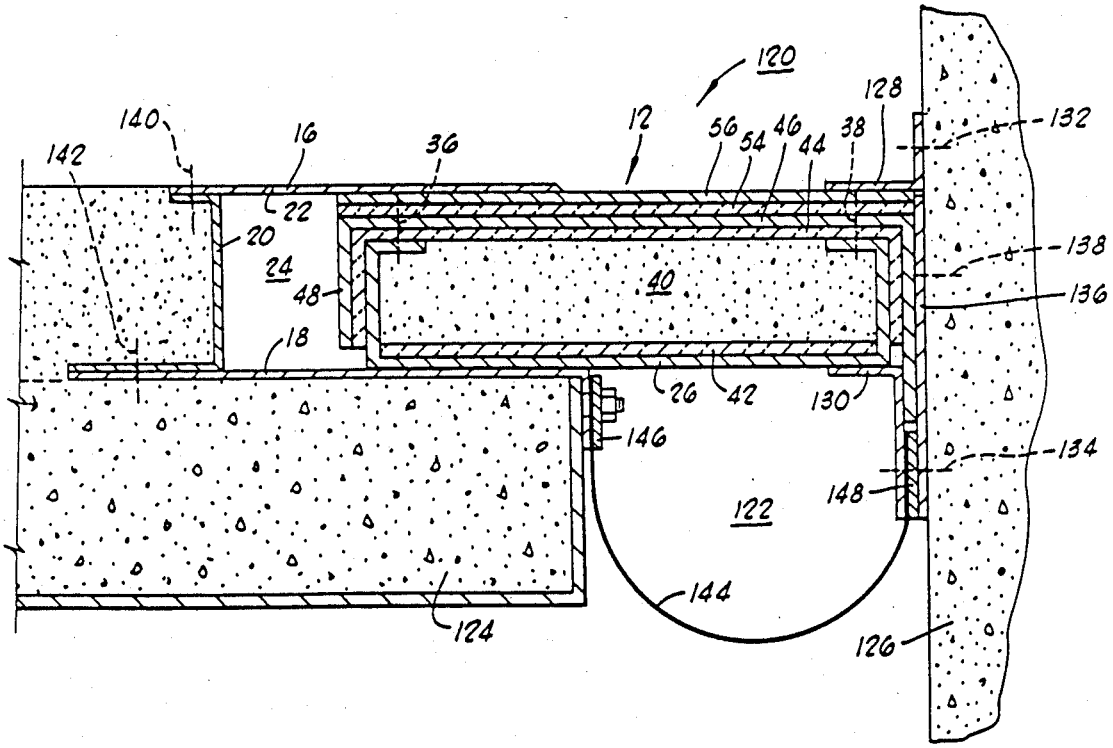
FIG. 3 is a vertical cross-section of an expansion joint cover as it may be constructed for floor-to-wall installation.

In some applications, it is desirable to include a flexible smoke barrier panel, for example, on opposite sides of the cover assembly 12 as shown by dash lines 110 and 112 within respective slide voids 80 and 88 or, alternately, across the expansion void as shown in FIG. 3. The flexible smoke barriers 110 and 112 may be connected across respective slide voids between the upper cover panel 56 of cover assembly 12 as tightly secured by fasteners 36, 38, with the smoke barriers loosely extending and having opposite sides secured adjacent the side plates and respective surface plates 82 and 86 of the shoulder members 78 and 86. This structure effectively isolates the smoke traversing upward from expansion void 76 and prevents the smoke from progressing through the slide voids for possible release between cover plate 56 and surface plates 82 and 90. It also provides additional resistance to loss of cooling vapors.

The smoke barrier material as utilized in flexible barriers 110 and 112 is presently constructed of a coated, flexible refractory cloth that exhibits fire resistance up to extremely high temperatures. The basic structure may be formed from such as a silica fiber cloth known commercially as "REFRASIL" as is commercially available, for example, from the Hitco Corporation, such fibercloth being pre-shrunk as formed from white, vitreous fibers having up to 99% silicon dioxide content. The material is available in bulk fiber, cloth, sleeving, yarn, etc., but in the present application it is utilized in continuous, pre-shrunk cloth lengths. A refractory fabric known as alumina silica cloth may also be used to good advantage. The silica fiber cloth is then further treated by continuous coating with silicone rubber, a well known silicone elastomer, and such coating process is carried out to result in a flexible, smoke impervious, barrier material that is non-flammable up to temperatures greater than 500° Fahrenheit.

FIG. 3 illustrates a floor-to-wall expansion joint cover 120 as used to cover an expansion void 122 bridging a floor shoulder 124 and a wall structure 126. The expansion joint cover 120 may be constructed essentially as the basic structure shown in FIG. 1. That is, the floor shoulder 124 may utilize such as base structure 16 defining slide void 24 and including base plate 18 and surface plate 22. The cover assembly 12 then slides laterally within slide void 24 as lower panel 26 rests on base plate 18 and upper cover panel 56 is closely received beneath surface plate 22.

The opposite side of cover assembly 12 is secured to the wall structure 126 by means of an upper bracket 128 and lower bracket 130 as secured to the wall by fasteners indicated by dashed lines 132 and 134, respectively. A backing plate 136 is secured by means of a fastener 138, and the cover assembly 12 is secured beneath upper bracket 128 by means of the securing fastener 38 (see FIG. 1). The base structure 16 may be similarly secured as by anchor bolts (dashed lines) 140 and 142 disposed in the grout and structural decking of floor shoulder 124.

As desired, a flexible smoke barrier 144 may be secured across the expansion void 122 as it is suitably secured by a clamping bar 146 connected to the flange of lower base plate 18 while the opposite side is secured beneath lower flange 130 and a spacer bar 148 by means of wall fastener 134. The smoke barrier 144 is similarly formed of the silica fiber cloth coated with silicone rubber in the manner previously set forth.

Figure 4:
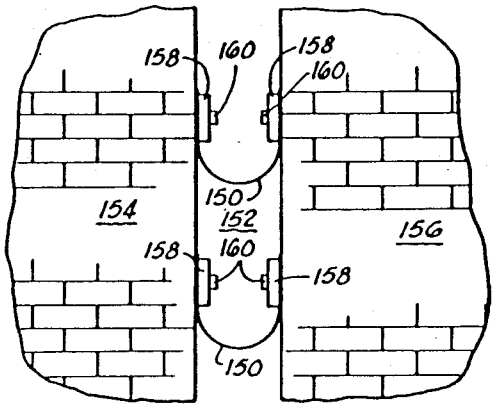
FIG. 4 is a view in elevation of an alternative smoke barrier usage.

FIG. 4 illustrates the manner in which one or more smoke barriers 150 may be employed to partition an expansion void 152 between two structures. Thus, the void 152 may be defined by such as a previously existing building structure 154 and a new adjoining structure 156 or any combination of closely adjacent free-standing structures. The smoke barriers 150 at selected spacing are sealingly secured on opposite sides by securing plates 158 and fasteners 160. Smoke barriers 150 are composed of refractory material as described above, i.e. such as silica fiber cloth coated with silicon rubber.

The foregoing discloses a novel fire resistant expansion joint cover which functions actively in releasing cooling vapors around the expansion voids and areas thereabove while also preventing upward pervasion of smoke and gases. The particular structural materials utilized in the present invention are deemed to provide multiple novel subjects as various facets of the expansion joint cover art receive benefit of improvement. Thus, the present invention provides a novel fire and/or heat barrier which effectively wicks vapor release in response to excessive heating, and the structure may further include heat and smoke barriers that are resistant to inordinately high temperatures.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A composition of matter for disposition in combination with a fire barrier void to release vapor when heated, comprising:

a fire barrier void having a sealable entry; and a mixture of silica gel with binder saturated with a non-flammable liquid adsorbed therein for generally sealed disposition in said fire barrier void.

2. A composition of matter as set forth in claim 1, wherein:

said binder is a commercial grade gypsum plaster.

3. A composition of matter as set forth in claim 2, wherein:

said silica gel and gypsum plaster are mixed in a ratio of six parts to one part, respectively.

4. A composition of matter as set forth in claim 1 wherein:

said non-flammable liquid is water.

5. A composition of matter as set forth in claim 3, wherein:

said non-flammable liquid is water.

6. A composition of matter for disposition in combination with a fire barrier void to release vapor when heated, comprising:

a fire barrier void having a sealable entry; and silica gel saturated with water adsorbed therein for generally sealed disposition in said fire barrier void.

* * * * *